US008516776B2

(12) United States Patent
Pan

(10) Patent No.: US 8,516,776 B2
(45) Date of Patent: Aug. 27, 2013

(54) FIRE-PREVENTION STRUCTURE FOR BUILDINGS

(76) Inventor: Chan-Ping Pan, Taipei (TW)

( * ) Notice: Subject to any disclaimer, the term of this patent is extended or adjusted under 35 U.S.C. 154(b) by 1146 days.

(21) Appl. No.: 11/865,732

(22) Filed: Oct. 2, 2007

(65) Prior Publication Data

US 2009/0084061 A1 Apr. 2, 2009

(51) Int. Cl.
*E04C 2/54* (2006.01)

(52) U.S. Cl.
USPC ..... 52/784.11; 52/236.3; 52/396.01

(58) Field of Classification Search
USPC ..... 52/783.14, 784.11, 656.7, 396.01, 52/236.3, 250, 263, 264, 309.4, 414, 320, 52/22
See application file for complete search history.

(56) References Cited

U.S. PATENT DOCUMENTS

| | | | | | |
|---|---|---|---|---|---|
| 1,978,012 | A * | 10/1934 | Cavey | 52/745.05 |
| 3,145,811 | A * | 8/1964 | Strehan et al. | 52/232 |
| 3,616,103 | A * | 10/1971 | Greiner et al. | 428/15 |
| 4,211,045 | A * | 7/1980 | Koizumi et al. | 52/251 |
| 4,221,092 | A * | 9/1980 | Johnson | 52/232 |
| 4,294,052 | A * | 10/1981 | Blauer | 52/236.5 |
| 4,333,285 | A * | 6/1982 | Koizumi et al. | 52/252 |
| 5,887,396 | A * | 3/1999 | Thoreson | 52/232 |
| 6,151,851 | A * | 11/2000 | Carter | 52/236.3 |
| 6,920,728 | B2 * | 7/2005 | Powers | 52/250 |
| 7,007,434 | B1 * | 3/2006 | Danielsson | 52/426 |
| 7,028,435 | B2 * | 4/2006 | Walker et al. | 52/236.5 |
| 7,197,854 | B2 * | 4/2007 | Bettigole et al. | 52/414 |
| 7,596,914 | B2 * | 10/2009 | Stahl et al. | 52/220.8 |
| 2004/0074176 | A1 * | 4/2004 | Baker | 52/263 |
| 2004/0168398 | A1 * | 9/2004 | Sakno et al. | 52/741.4 |
| 2004/0255534 | A1 * | 12/2004 | Fan | 52/309.4 |
| 2005/0217190 | A1 * | 10/2005 | Simmons | 52/220.1 |
| 2005/0246988 | A1 * | 11/2005 | Patrick | 52/309.11 |
| 2007/0130864 | A1 * | 6/2007 | Semmens et al. | 52/408 |

* cited by examiner

*Primary Examiner* — William Gilbert
*Assistant Examiner* — James Ference
(74) *Attorney, Agent, or Firm* — Ming Chow; Sinorica, LLC

(57) ABSTRACT

A fire-prevention structure for buildings includes at least a first fire-prevention district, a fire-prevention floor slab, and a second fire-prevention district. The first fire-prevention district having at least a steel-structured story further includes a plurality of first steel columns and a plurality of first steel beams. The first steel column is a hollow rectangular column with an upper end opening. The first steel beam is connected to a lateral side of the first steel column. The fire-prevention floor slab is constructed on top of the first steel beams and partly inside the end opening of the first steel column. The second fire-prevention district having at least a steel-structured story further includes a plurality of second steel columns and a plurality of second steel beams. The second steel column has a lower end portion further extruding an engagement plate and an engagement column. The engagement plate is fixed to the fire-prevention floor slab through anchor bolting, and the engagement column is protruded into the end opening of the first steel column.

4 Claims, 3 Drawing Sheets

FIRE-PREVENTION STRUCTURE FOR BUILDINGS

BACKGROUND OF THE INVENTION (1) Field of the Invention

The present invention relates to a fire-prevention structure for buildings, and more particularly to a fire-prevention structure that can effectively isolate a fire in the building so as to avoid a possible catastrophic collapse of the building.

(2) Description of the Prior Art

In a metropolitan area, skyscrapers have become an inevitable solution to accommodate the growing population. The frames being used by most of the skyscrapers are steel structures, featuring in light weight, quick construction, and performance. Therefore, in constructing a skyscraper, the steel structure is considered to be superior to the steel-reinforced concrete structure.

Referring now to FIG. 1A and FIG. 1B, a typical structure for most of steel-structured buildings is elucidated by a schematic front view and a detail view on a joint area, respectively. The structure 1 includes a plurality of steel-structured stories 11. Each of the stories 11 includes a plurality of steel columns 112, steel beams 114, and floor slabs 116. Generally, the butt welding of steel columns 112*a* and 112*b* between the stories 11 is a full permeation butt welding (FPBW). As shown, the steel beam 114 is jointed to a lateral side 3110 of the steel column 112, and the floor slab 116 is mounted upon the steel beam 114.

It is well known that a major disadvantage of the steel structure is its weakness of the heat-resistance. In the conventional structure 1, the connection between the steel columns 112*a*, 112*b* or between the steel column 112*a* and the steel beam 114 is made by direct welding. When a fire occurs to the steel-structured building, and the temperature reaches a thousand degrees, the fire with the temperature would quickly soften the steel structures. Further by the heat conductivity of the steels, the high temperature will be rapidly spread out to the whole steel structures of the building. As soon as any steel column 112 of the structure 1 begins to melt, a possible buckling would attack the steel column 112. When the buckled steel column 112 cannot support the load contributed by the portion of the building above the steel column 112, a possible collapse of the building would happen just like what happened to the World Trade Center during the "911".

SUMMARY OF THE INVENTION

It is an objective of the present invention to provide a fire-prevention structure for buildings, by which the major heat of the fire can be limited within a specific region to prevent a possible collapse.

In the present invention, the fire-prevention structure for buildings includes at least a first fire-prevention district, a fire-prevention floor slab, and a second fire-prevention district, in which the fire-prevention floor slab is constructed between the first fire-prevention district and the second fire-prevention district.

The first fire-prevention district further includes at least a steel-structured story. The steel-structured story has a plurality of first steel columns and a plurality of first steel beams. The first steel column is a hollow rectangular column with an end opening. The first steel beam is connected to a lateral side 3110 of the first column.

The fire-prevention floor slab includes a corrugated steel roof plate and a fire-resistant material. The corrugated steel roof plate is engaged with the first column. The fire-resistant material is layered on the corrugated steel roof plate and filled into the end opening of the first column. In the present invention, the fire-resistant material can be a steel-fiber reinforced concrete, a calcium silicate, or an asbestos.

The second fire-prevention district further includes at least a steel-structured story. The steel-structured story has a plurality of second steel columns and a plurality of second steel beams. The second steel column has a lower end portion extruding an engagement plate and an engagement column. The engagement plate is fixed to the fire-prevention floor slab through an anchor bolting, and the engagement column is protruded into the end opening of the first steel column. The engagement column has a plurality of peripheral shear connectors to ensure the holding of the engagement column with the fire-resistant material inserted inside the end opening.

In the present invention, the fire-prevention structure divides the whole building structure into a plurality of fire-prevention districts, in which any two adjacent fire-prevention districts are not directly engaged, instead, being engaged through the in-between fire-prevention floor slab. The fire-prevention floor slab is made of fire-resistant material by which the fire and the heat generated by the fire in any single fire-prevention district can be controlled substantially within the particular incidental fire-prevention district.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The present invention discloses a structure for a fire-prevention building. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
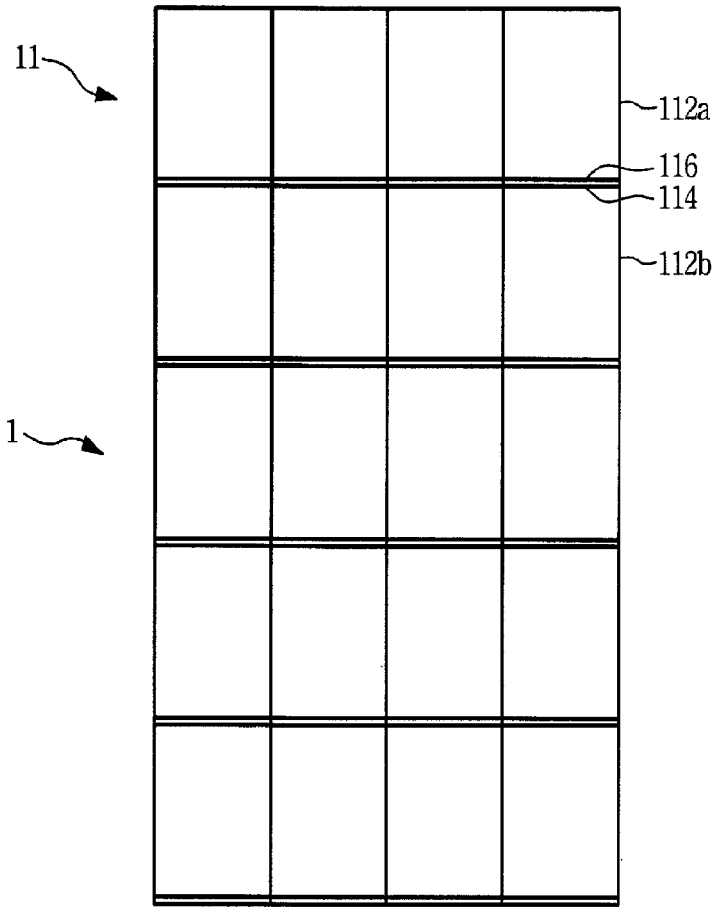
FIG. 1 A (Prior Art)
FIG. 1A shows a typical structure for most of the conventional steel-structured buildings.
FIG. 1B shows a detail view of a joint area of FIG. 1A.
Figure 1:
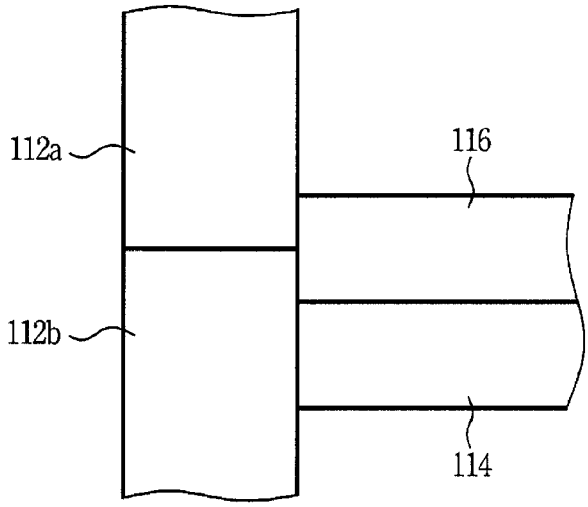
FIG. 1 B (Prior Art)
Figure 2A:
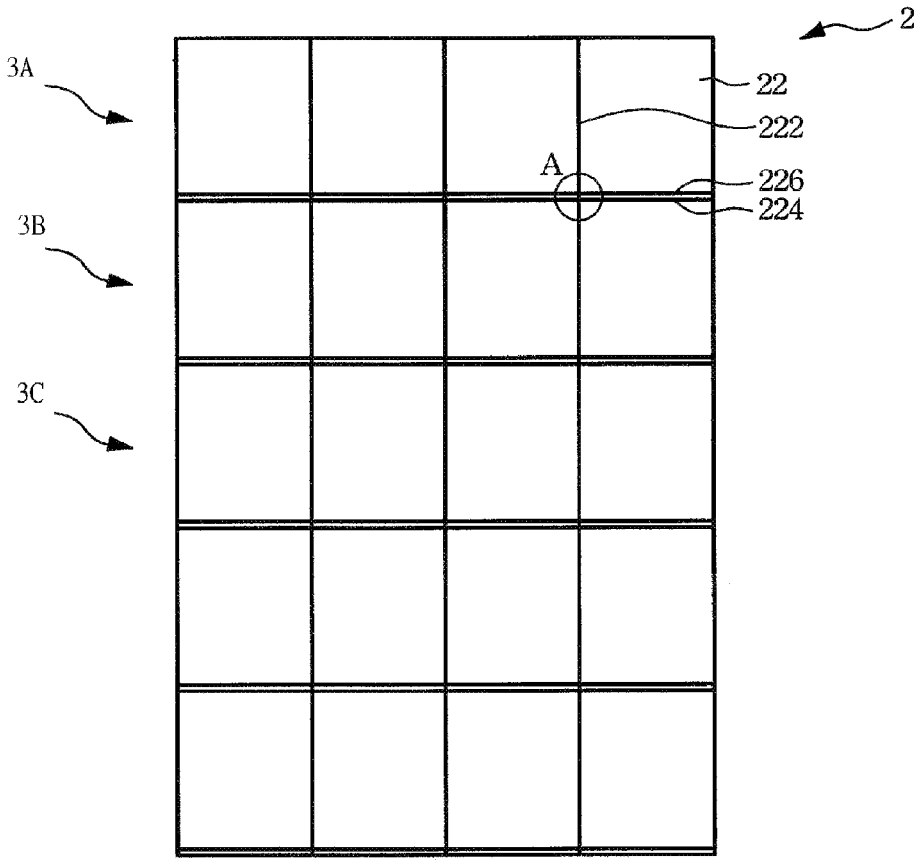
FIG. 2A is a schematic view of a preferred fire-prevention structure in accordance with the present invention.

Referring now to FIG. 2A, a preferred fire-prevention structure 2 for buildings in accordance with the present invention is schematically illustrated. The fire-prevention structure 2 for buildings has a plurality of steel-structured stories 22. Each of the stories 22 includes a plurality of steel columns 222 and a plurality of steel beams 224. A floor slab is mounted to separate the adjacent stories 22. In the present invention, the whole structure 2 is divided into a plurality of fire-prevention districts 3A, 3B, 3C. Each of the fire-prevention districts 3A, 3B, 3C includes at least one steel-structured story 22. Between the adjacent fire-prevention districts 3A, 3B, a fire-prevention floor slab 226 is mounted. In FIG. 2A, the fire-prevention floor slabs 226 are illustrated.

Figure 2B:
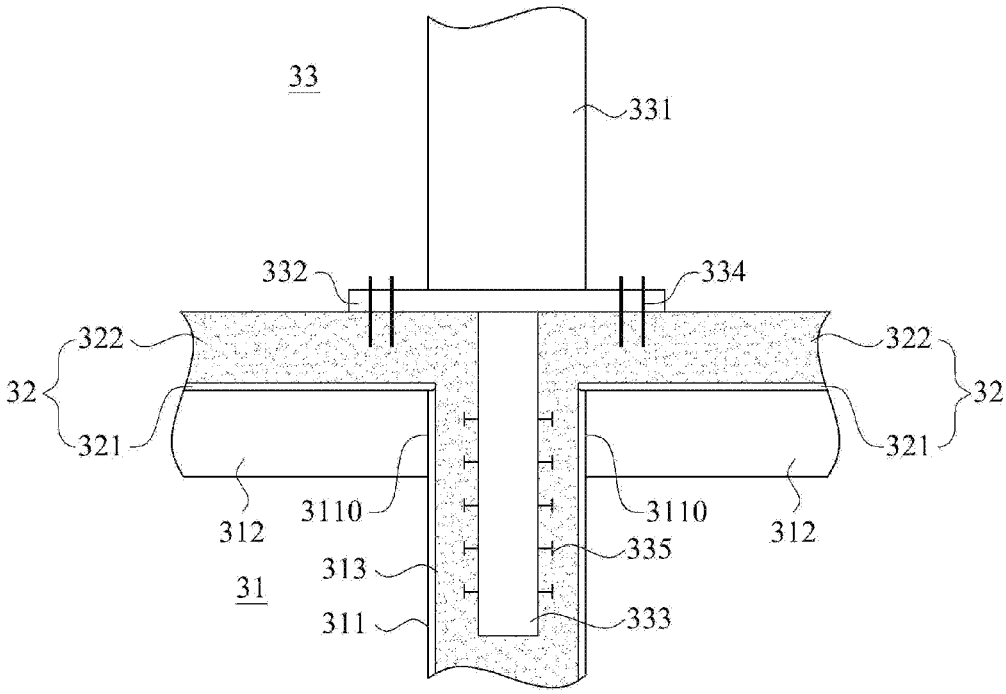
FIG. 2B is an enlarged view of area A of FIG. 2A.

In FIG. 2B, an enlarged view upon a typical conjunction (area A in FIG. 2A) between two consecutive fire-prevention districts 3A, 3B of the present invention is shown. In this conjunction, the lower fire-prevention district 3B is labeled as a first fire-prevention district 31, the upper fire-prevention district 3A is labeled as a second fire-prevention district 33, and the fire-prevention floor slab 226 in FIG. 2A is relabeled as the fire-prevention floor slab 32.

As shown in FIG. 2B, the first fire-prevention district 31 having at least a steel-structured stories includes a plurality of first steel columns 311 and a plurality of first steel beams 312. Each of the first steel columns 311 is a hollow rectangular column with an upper end opening 313. The first steel beam 312 is connected to a lateral side 3110 of the first column 311. The fire-prevention floor slab 32 includes a corrugated steel roof plate 321 and a fire-resistant material 322. The corrugated steel roof plate 321 is engaged with the first column 311. The fire-resistant material 322 is layered on the corrugated steel roof plate 321 and also partly filled into the end opening 313 of the first column 311. In the present invention, the fire-resistant material 322 can be a steel-fiber reinforced concrete, a calcium silicate, an asbestos, or the like. The second fire-prevention district 33 also having at least a steel-structured story includes a plurality of second steel columns 331 and a plurality of second steel beams (not shown in FIG. 2B). Each of the second steel columns 331 is designed either as an I beam or a hollow rectangular beam having a lower end portion extruding an engagement plate 332 and an engagement column 333. The engagement plate 332 is fixed to the fire-prevention floor slab 32 through anchor bolts 334, and the engagement column 333 is protruded downward into the end opening 313 of the first steel column 311. The engagement column 333 has a plurality of peripheral shear connectors 335 to ensure the holding between the engagement column 333 and the fire-resistant material 322 inserted inside the end opening 313.

In the present invention, the fire-prevention structure divides the whole building structure 2 into a plurality of fire-prevention districts 3A, 3B, 3C, in which, for example in FIG. 2B, the steel columns 311 and 331 of the consecutive fire-prevention districts 31 and 33 respectively are not directly engaged. Instead, they are engaged through the in-between fire-prevention floor slab 32. The fire-prevention floor slab 32 is made of a fire-resistant material 322 in order to prevent easy propagation of the fire between the fire prevention districts. Therefore, the first steel column 311 of the first fire-prevention district 31 will not be buckled by the heat in the second fire-prevention district 33.

While the present invention has been particularly shown and described with references to a preferred embodiment, it will be understood by those skilled in the art that various changes in form and detail may be made without departing from the spirit and scope of the present invention.

I claim:

1. A fire-prevention structure for buildings, comprising:

a first fire-prevention district, having at least a steel-structured story, further including a plurality of first steel columns and a plurality of first steel beams;

the first steel column being formed as a hollow rectangular column and having an upper end opening;

the first steel beam being connected to a lateral side of the respective first steel column;

a fire-prevention floor slab, constructed on top of the first steel beams and protruded partly into the end opening of the first steel column; and a second fire-prevention district having at least a steel-structured story, including a plurality of second steel columns and a plurality of second steel beams, having a lower end portion to extrude downward an engagement plate and an engagement column;

the engagement plate being fixed to the fire-prevention floor slab;

the engagement column, having a plurality of peripheral shear connectors, being protruded downward into the end opening of the first steel column and being embraced by the fire-prevention floor slab;

said engagement plate and said fire-prevention floor slab are connected with a plurality of anchor bolts; said fire-prevention floor slab includes a corrugated steel roof plate and a fire-resistant material, the corrugated steel roof plate being engaged with said first steel column, the fire-resistant material being layered on the corrugated steel roof plate and also partly filled into said end opening of said first steel column; and the first fire-prevention district and the second fire-prevention district are not directly engaged, but connected to each other through the fire-prevention floor slab in between.

2. The fire-prevention structure for buildings according to claim 1, wherein said fire-resistant material is a steel-fiber reinforced concrete.

3. The fire-prevention structure for buildings according to claim 1, wherein said fire-resistant material is a calcium silicate.

4. The fire-prevention structure for buildings according to claim 1, wherein said fire-resistant material is an asbestos.

* * * * *